US007909186B1

(12) United States Patent
Contreras

(10) Patent No.: US 7,909,186 B1
(45) Date of Patent: Mar. 22, 2011

(54) CLOTHES HANGER APPARATUS

(76) Inventor: Arturo Contreras, San Antonio, TX (US)

( * ) Notice: Subject to any disclaimer, the term of this patent is extended or adjusted under 35 U.S.C. 154(b) by 270 days.

(21) Appl. No.: 12/247,147

(22) Filed: Oct. 7, 2008

(51) Int. Cl.
*A47H 13/00* (2006.01)

(52) U.S. Cl. ..... 211/124; 211/197

(58) Field of Classification Search ..... 211/123, 211/124, 94.01, 94.02, 94.03, 119.13, 89.01, 211/100, 85.3, 105.1, 121, 193, 190, 175, 211/207, 197, 45, 46; 248/215, 339; 223/89, 223/85; 24/453, 458, 297
See application file for complete search history.

(56) References Cited

U.S. PATENT DOCUMENTS

| | | | | | |
|---|---|---|---|---|---|
| 829,837 | A | * | 8/1906 | Brisacher | 24/453 |
| 1,857,293 | A | * | 5/1932 | Vroom | 16/87.8 |
| 2,068,451 | A | * | 1/1937 | Elmore | 211/124 |
| 2,110,158 | A | * | 3/1938 | Keeler | 211/182 |
| 2,302,233 | A | * | 11/1942 | Maddox | 211/123 |
| 2,757,804 | A | * | 8/1956 | Sadwin | 211/94.01 |
| 2,771,196 | A | * | 11/1956 | Scheuermann | 211/94.02 |
| 2,813,634 | A | * | 11/1957 | Andersson | 211/85.3 |
| 2,975,949 | A | * | 3/1961 | Lutsky | 223/91 |
| 3,023,450 | A | * | 3/1962 | Renner et al. | 16/87.6 R |
| 3,027,015 | A | * | 3/1962 | Miller | 211/85.3 |
| 3,110,068 | A | * | 11/1963 | Perrochat | 24/297 |
| 3,527,361 | A | * | 9/1970 | Janetka | 211/182 |
| 3,599,457 | A | * | 8/1971 | Kamp | 70/459 |
| 3,610,423 | A | | 10/1971 | Parillo | |
| 3,620,376 | A | | 11/1971 | Gingher | |
| 3,993,195 | A | | 11/1976 | Caligiuri | |
| 4,336,885 | A | | 6/1982 | Thomas | |
| 4,408,375 | A | * | 10/1983 | Skobel | 24/615 |
| 4,640,420 | A | | 2/1987 | McKay | |
| D304,528 | S | | 11/1989 | Handler et al. | |
| 4,973,212 | A | * | 11/1990 | Jacobs | 411/508 |
| 5,018,627 | A | | 5/1991 | Moore | |
| 5,320,228 | A | | 6/1994 | Chen | |
| 5,421,059 | A | * | 6/1995 | Leffers, Jr. | 16/87.4 R |
| 6,719,158 | B2 | * | 4/2004 | Goldberg | 211/123 |
| 2002/0079277 | A1 | * | 6/2002 | Huang | 211/206 |
| 2004/0020949 | A1 | * | 2/2004 | Yip | 223/85 |
| 2010/0019002 | A1 | * | 1/2010 | Gouldson | 223/85 |

* cited by examiner

*Primary Examiner* — Darnell M Jayne
*Assistant Examiner* — Patrick Hawn
(74) *Attorney, Agent, or Firm* — Crossley Patent Law; Mark A. Crossley

(57) ABSTRACT

The clothes hanger apparatus has a pair of spaced apart foot assemblies, a vertical member extended upwardly from each foot assembly, a right angle bend at a top of each vertical member, a sleeve extended from each bend, a horizontal tube removably connecting the sleeves, a slot in a bottom of the tube, a plurality of roller assemblies selectively fitted within the tube, a plurality of stems, each stem having a top end and a bottom end, the top end removably connected to one roller assembly, a clip connected to the bottom end of each stem, a hanger mustache removably connected to each clip, respectively.

1 Claim, 7 Drawing Sheets

CLOTHES HANGER APPARATUS

BACKGROUND OF THE INVENTION

The plurality of devices provided for hanging clothes is testimony to the varying needs for such devices. Several concerns exist in clothes hanging. First, many hangers are quite prone to tangle, and therefore very inconvenient to use and tolerate. Further, clothes on most hangers, especially heavy clothes, are often difficult to move laterally on what ever device or bar is supporting them. Additionally, hanger theft and loss is frequent with many hanger systems and devices. The present apparatus offers solutions to these and other problems with a mobile apparatus which is length adjustable. The apparatus provides smooth sliding and positioning of any hung clothes. The apparatus provides theft deterrence in that the hanger mustaches are selectively separable from the remaining apparatus, thereby providing a hanger mustache of no use with any other system or device.

FIELD OF THE INVENTION

The clothes hanger apparatus relates to devices for hanging clothes and more especially to a length adjustable clothes hanging apparatus which provides for easy movement of hanging clothes without entanglement and also provides for selective separation of the hanger mustache from the remainder of the apparatus.

SUMMARY OF THE INVENTION

The general purpose of the clothes hanger apparatus, described subsequently in greater detail, is to provide a clothes hanger apparatus which has many novel features that result in an improved clothes hanger apparatus which is not anticipated, rendered obvious, suggested, or even implied by prior art, either alone or in combination thereof.

To attain this, the clothes hanger apparatus provides for convenience and ease of use in hanging various clothing in a closet or any other space in which the apparatus can be selectively located. The apparatus negates hanger tangle associated with most clothes hanging devices. The removable horizontal slotted tube provides for various tube lengths of tubes to be used, to accommodate a variety of spaces into which the apparatus can be removably located. The removable tube also provides for a varied number of roller assemblies to be fitted to the tube, thereby increasing or decreasing the number of hanger mustaches offered for clothes.

Further convenience is provided by the removable mustaches onto which clothes are hung. The separable mustaches also discourage theft, as in a commercial setting, because the mustaches are of no use without the mustaches mates. The outer perimeter tapers and design of the roller assemblies are important in providing for ease of movement of the roller assemblies within the slotted tube. The apparatus can be made from a variety of materials, including metals and synthetics, with plastics being ideal due to light weight and lack of expense. The apparatus is also provided in a more basic version without the vertical members and foot assemblies, whereby the slotted tube can be positioned as desired, with roller assemblies and mustaches used as with the more complete embodiment.

Thus has been broadly outlined the more important features of the improved clothes hanger apparatus so that the detailed description thereof that follows may be better understood and in order that the present contribution to the art may be better appreciated.

An object of the clothes hanger apparatus is to provide for conveniently hanging clothing without hanger tangle.

Another object of the clothes hanger apparatus is to deter theft of hangers.

A further object of the clothes hanger apparatus is to provide for fit to a variety of space sizes.

An added object of the clothes hanger apparatus is to be free standing and portable.

And, an object of the clothes hanger apparatus is to provide for selective separation of the hanger mustache from the apparatus.

These together with additional objects, features and advantages of the improved clothes hanger apparatus will be readily apparent to those of ordinary skill in the art upon reading the following detailed description of presently preferred, but nonetheless illustrative, embodiments of the improved clothes hanger apparatus when taken in conjunction with the accompanying drawings.

In this respect, before explaining the current embodiments of the improved clothes hanger apparatus in detail, it is to be understood that the clothes hanger apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved clothes hanger apparatus. It is therefore important that the claims be regarded as including such equivalent constructions insofar as they do not depart from the spirit and scope of the clothes hanger apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 7 thereof, the principles and concepts of the clothes hanger apparatus generally designated by the reference number 10 will be described.

Figure 1:
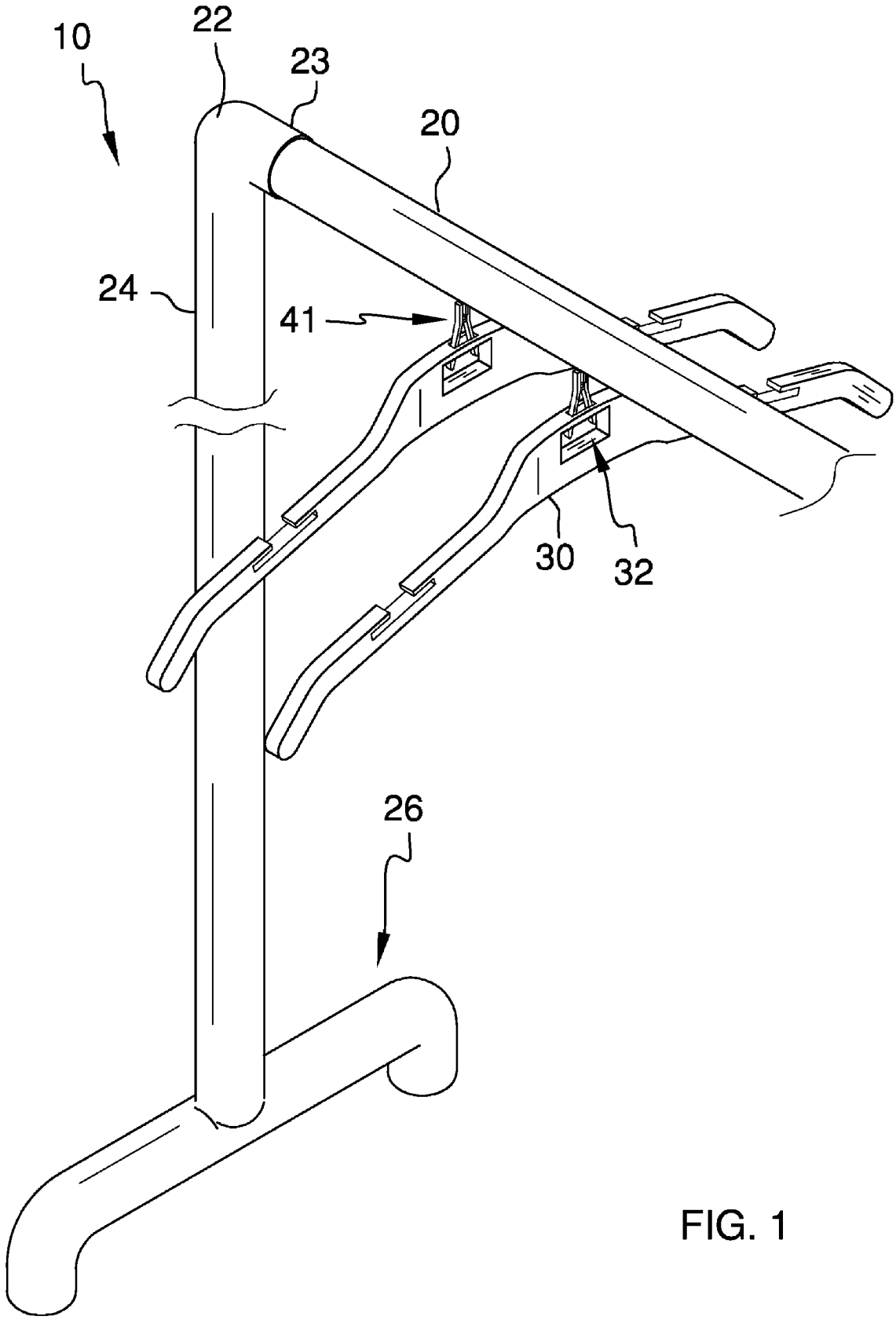
FIG. 1 is a perspective view toward one end of the apparatus.
Figure 2:
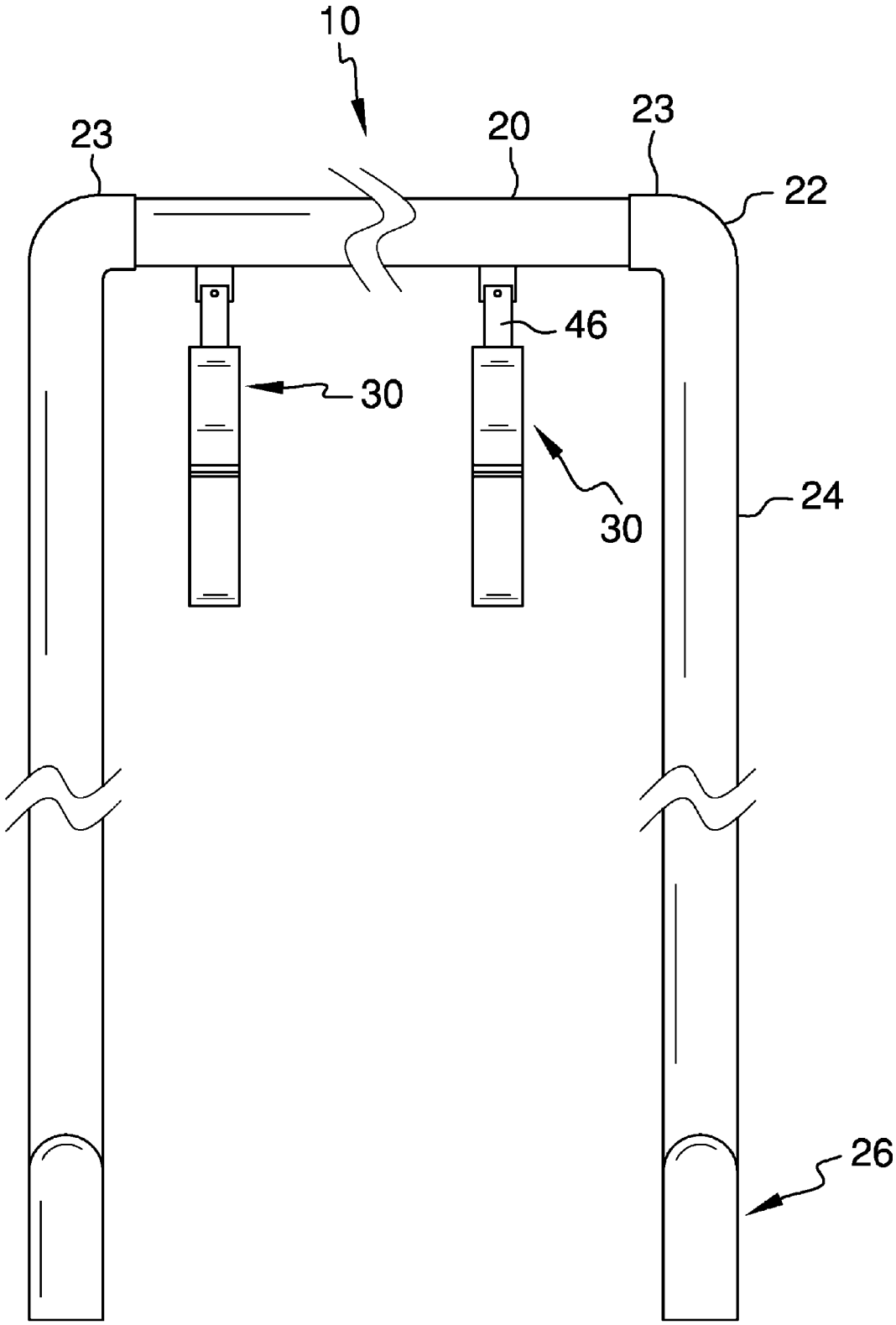
FIG. 2 is a front elevation view.
Figure 3:
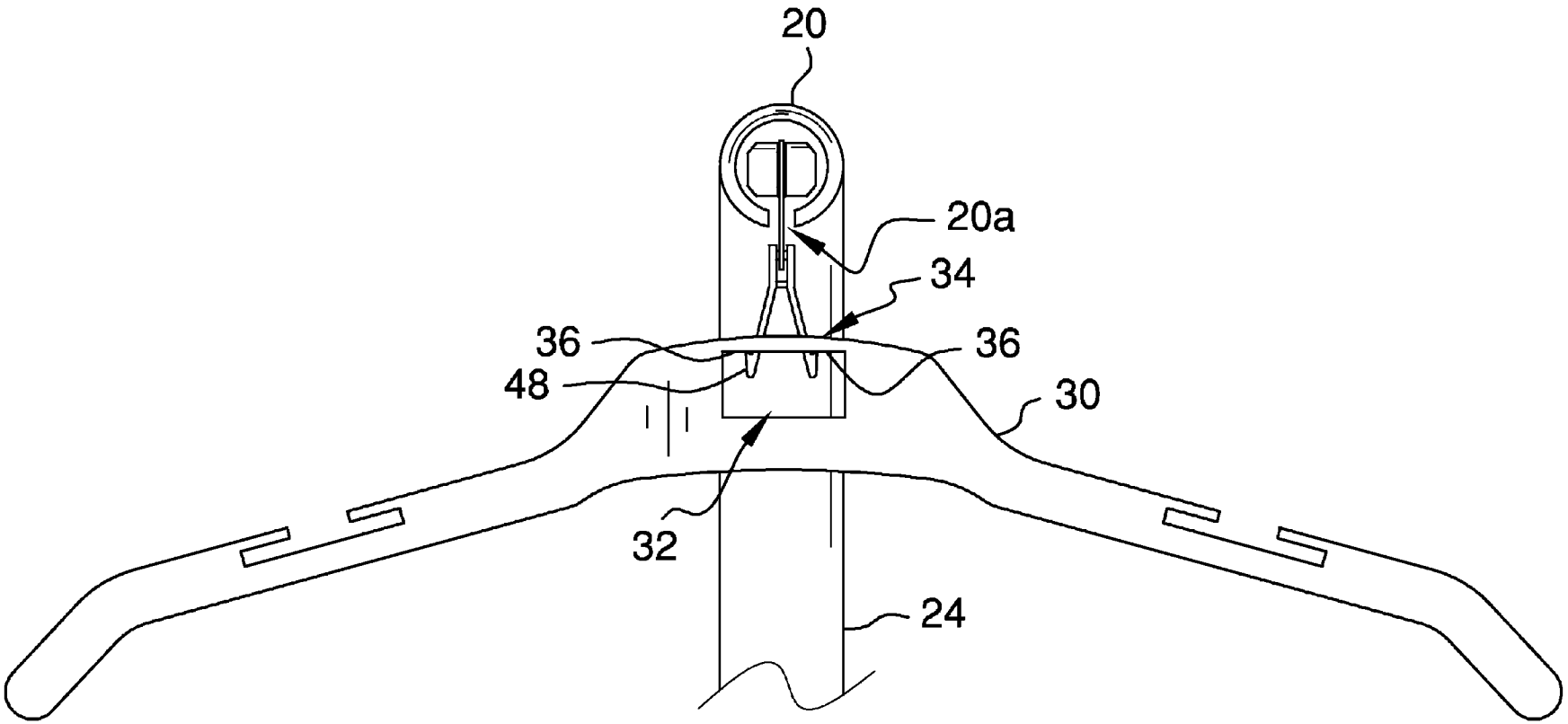
FIG. 3 is a partial cross sectional end view.
Figure 4:
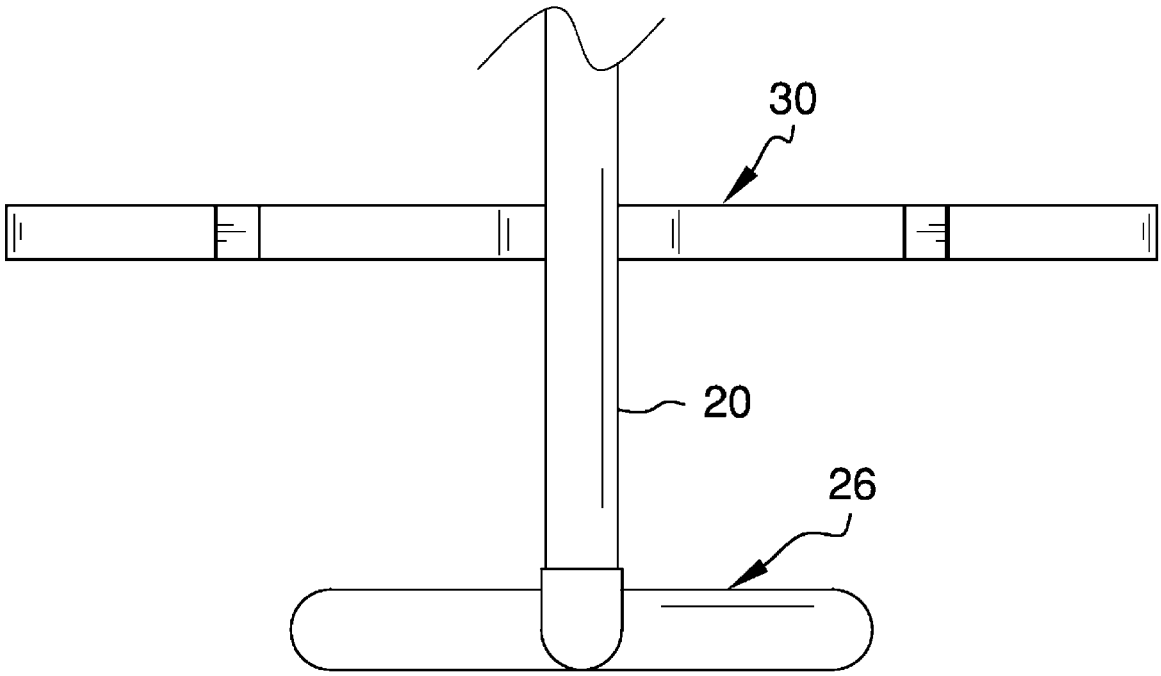
FIG. 4 is a top plan view of one end of the apparatus.
Figure 5:
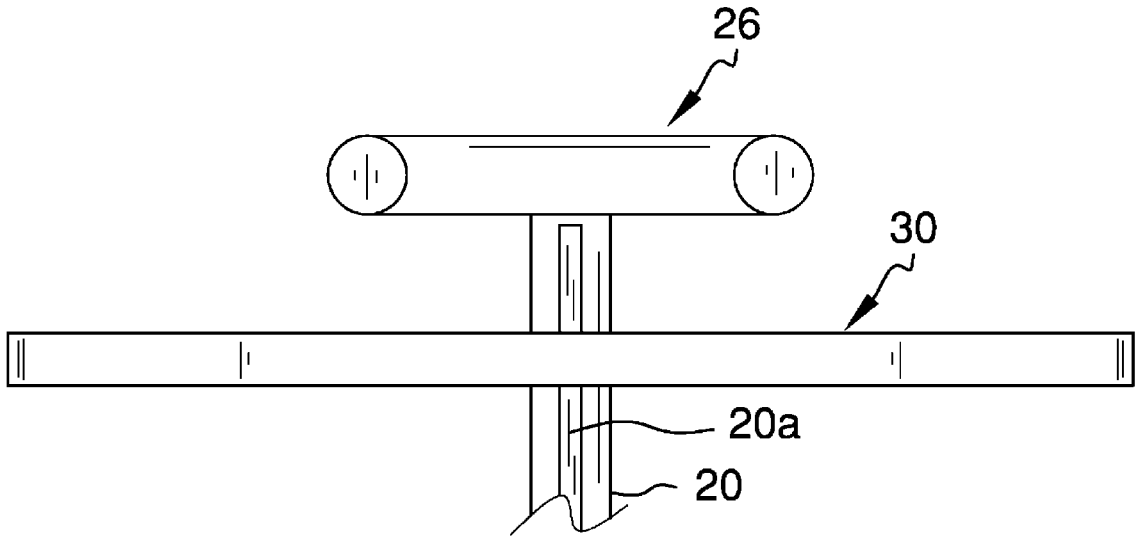
FIG. 5 is a bottom plan view of one end of the apparatus.
Figure 6:
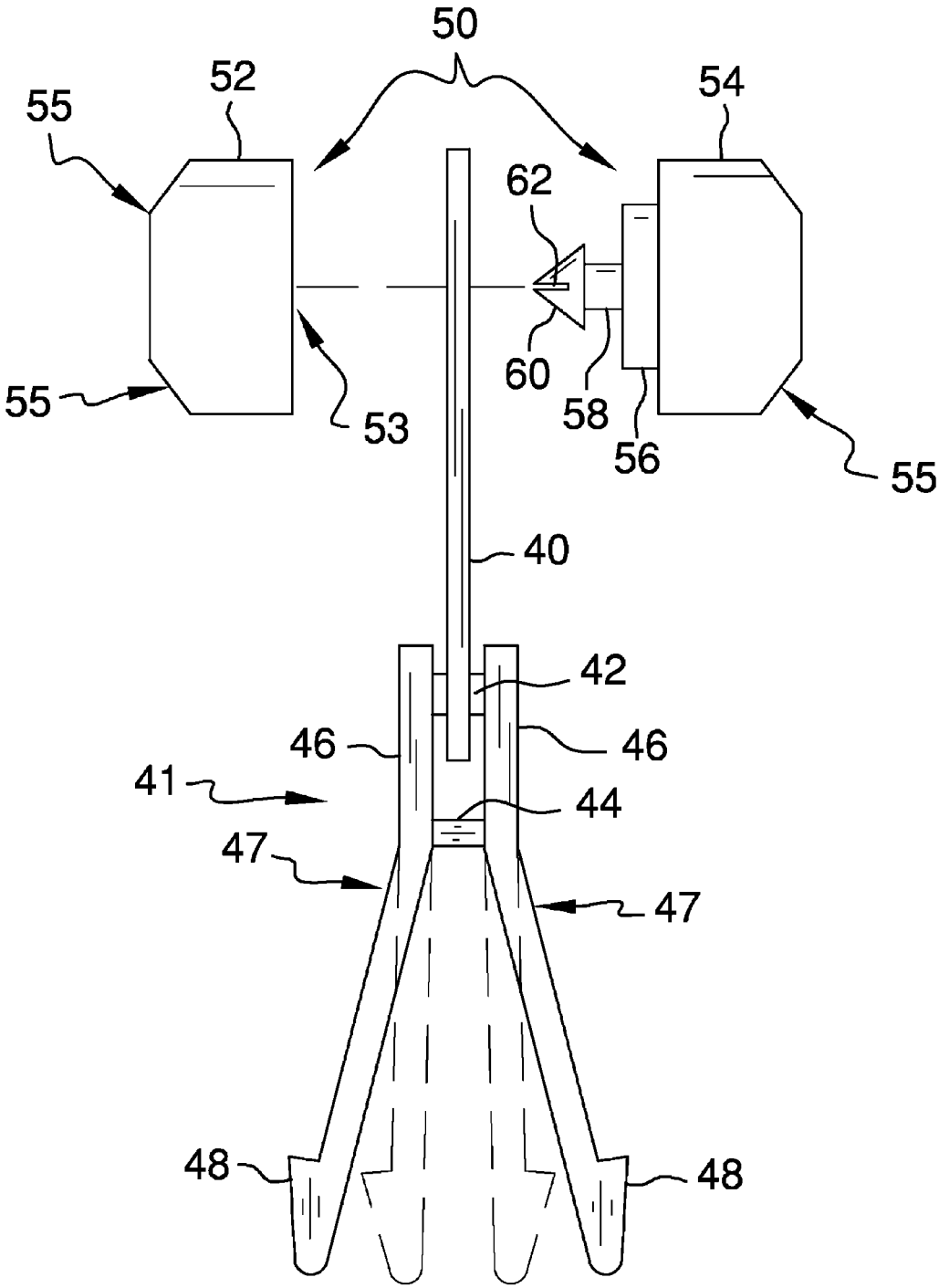
FIG. 6 is a partially exploded view of one roller assembly and one mustache mate.
Figure 7:
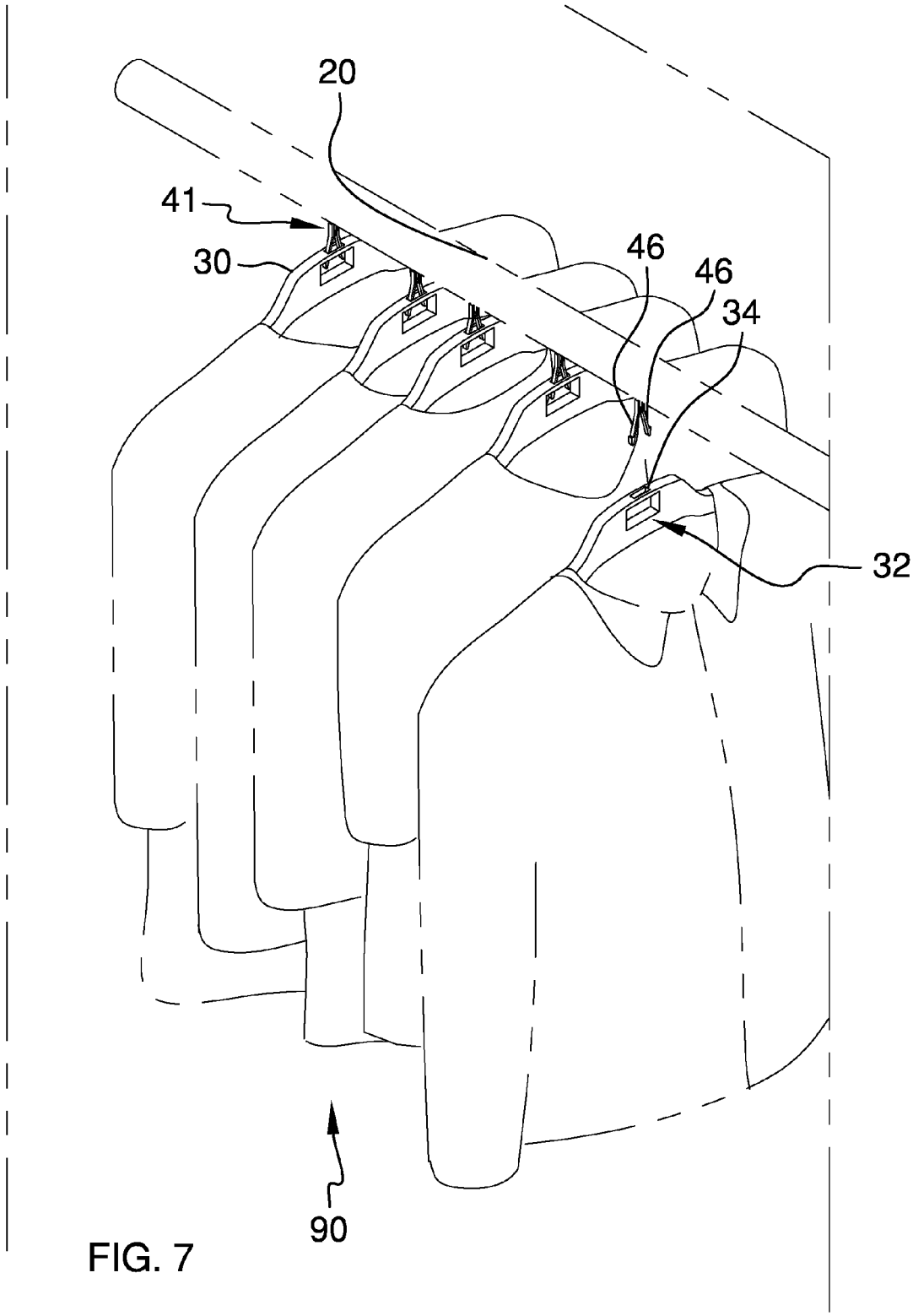
FIG. 7 is a perspective view of clothing hung on the apparatus.

Referring to FIG. 7, the apparatus 10 provides for removably hanging clothing 90, with hanger mustaches 30 removably fitted to each mustache mate, for convenience in adding or removing clothing 90.

Referring to FIGS. 1-6, the clothes hanger apparatus 10 comprises, in combination, a pair of spaced apart foot assemblies 26 providing support for the apparatus 10. A vertical member 24 is extended upwardly from each foot assembly 26. A right angle bend 22 is disposed at the top of each vertical member 24. A sleeve 23 is extended from each bend 22. A horizontal tube 20 thereby removably inserts within and connects the bends 22. The slot **20*a* is disposed in the bottom and throughout the length of the tube 20. The plurality of roller assemblies 50 is provided. Each roller assembly 50 is removably fitted within the tube 20**.

Each roller assembly comprises a female semispherical 52 having an outer perimeter taper 55. A receiver 53 is disposed in the center of the each female semispherical 52. The receiver 53 is disposed opposite the outer perimeter taper 55. A male semispherical 54 is provided to mate with each female semispherical 52. Each male semispherical 54 has an outer perimeter taper 55. Each male semispherical 54 further comprises an inner diameter step 56 disposed opposite the taper 55. A shaft 58 is extended from the inner diameter step 56. The wedge insert 60 is extended from the shaft 58. The gap 62 is provided in the end of the wedge insert 60 in order to assist with insertion of the insert 60 into the female semispherical 52 receiver 53. A plurality of mustache mates 41 is provided with each apparatus 10. Each mustache mate 41 provides for connection between one mustache 30 and one roller assembly 50. A pair of spaced apart flex clips 46 is attached to the connector 42 of each mustache mate 41. Each flex clip 46 has an outward flare 47 ending in a retainer 48. A brace 44 further connects each pair of flex clips 46. Flex clips 46 are squeezed inwardly in order to be inserted into the entrance 34 to the opening 32 of a mustache 30, then released for retention of the retainers 48 by the lips 36. The stem 40 has an upper end and a lower end. Positive, removable retention of mustache mates 41 to mustaches 30 is thereby provided. The upper end of each stem 40 is pivotally fitted around the inner diameter step 56 of the male semispherical 54, prior to assembly of the male semispherical 54 to the female semispherical 52. The lower end of the stem 40 is pivotally fitted around the connector 42. Pivotal fit at each end of the stem 40 is important in that pivot provides for clothes to easily hang straight downwardly from the slotted tube 20, without any tendency toward fore or aft tilt.

With respect to the above description then, it is to be realized that the optimum dimensional relationships for the parts of the clothes hanger apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the clothes hanger apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the clothes hanger apparatus may be used.

Therefore, the foregoing is considered as illustrative only of the principles of the clothes hanger apparatus. Further, since numerous modifications and changes will readily occur to those skilled in the art, it is not desired to limit the clothes hanger apparatus to the exact construction and operation shown and described, and accordingly, all suitable modifications and equivalents may be resorted to, falling within the scope of the clothes hanger apparatus.

What is claimed is:

1. A clothes hanger apparatus comprising, in combination:

a pair of spaced apart foot assemblies;

a vertical member extended upwardly from each foot assembly;

a right angle bend at a top of each vertical member;

a sleeve extended from each bend;

a horizontal tube removably connecting the sleeves;

a slot in a bottom of the tube;

a plurality of roller assemblies removably fitted within the tube, each roller assembly comprising:

a female semispherical member having an outer perimeter taper;

a receiver in a center of the female semispherical member, the receiver opposite the taper;

a male semispherical member having an outer perimeter taper;

an inner diameter step on the male semispherical member, the step opposite the taper;

a shaft extended from the inner diameter step;

a wedge insert extended from the shaft, a gap in an end of the wedge insert, the wedge insert fitted into the female semispherical receiver;

a plurality of mustache mates, each mustache mate further comprising:

a pair of spaced apart flex clips attached to a connector, each flex clip having an outward flare ending in a retainer;

a brace further connecting each pair of flex clips;

a stem having an upper end and a lower end, the upper end pivotally fitted around the inner diameter step of the male semispherical member, the lower end pivotally fitted around the connector;

a plurality of mustaches, each mustache in removable receipt of clothing, each mustache comprising a centrally disposed opening having a lip around a top of the opening, the lip in removable receipt of the retainers of one pair of flex clips of one mustache mate.

* * * * *